US005772347A

United States Patent [19]

Gueret

[11] Patent Number: 5,772,347

[45] Date of Patent: Jun. 30, 1998

[54] DISPENSER FOR A PRODUCT WITH A LIQUID-TO-PASTY CONSISTENCY

[75] Inventor: Jean-Louis Gueret, Paris, France

[73] Assignee: L'Oreal, Paris, France

[21] Appl. No.: 568,324

[22] Filed: Dec. 6, 1995

[30] Foreign Application Priority Data

Dec. 6, 1994 [FR] France ..... 94 14652

[51] Int. Cl.[6] ..... A45D 40/00; A45D 40/06; A45D 40/08

[52] U.S. Cl. ..... 401/263; 401/175; 401/266

[58] Field of Search ..... 401/175, 263, 401/266

[56] References Cited

U.S. PATENT DOCUMENTS

| | | | |
|---|---|---|---|
| 1,968,686 | 7/1934 | Janer | 401/175 X |
| 2,069,442 | 2/1937 | Heseltine | 401/263 |
| 2,196,379 | 4/1940 | Bender | 401/266 X |
| 2,232,140 | 7/1941 | Rupp | 401/263 |
| 2,283,463 | 5/1942 | Rupp | 401/263 |
| 2,336,357 | 12/1943 | Hixson . | |
| 2,374,065 | 4/1945 | Worthington . | |
| 2,442,503 | 6/1948 | Melnikoff . | |
| 2,448,033 | 8/1948 | Kruck | 401/266 X |
| 2,816,309 | 12/1957 | Worth et al. | 401/175 |
| 2,961,679 | 11/1960 | Claypool | 401/266 X |
| 3,807,881 | 4/1974 | Seidler | 401/175 |
| 4,002,182 | 1/1977 | Michel | 401/263 |

FOREIGN PATENT DOCUMENTS

| | | | |
|---|---|---|---|
| 514281 | 7/1955 | Canada | 401/263 |
| 667224 | 10/1929 | France | 401/175 |
| 813194 | 5/1937 | France . | |
| 3526109 | 1/1987 | Germany . | |
| 4016353 | 5/1989 | Germany . | |

*Primary Examiner*—Steven A. Bratlie
*Attorney, Agent, or Firm*—Young & Thompson

[57] ABSTRACT

The invention relates to an applicator nozzle (2) for the dispensing and the application of a product (P) with a liquid-to-pasty consistency, comprising an application surface (5) provided with at least one dispensing orifice (61). This nozzle is provided with a one-way valve (62*b*) allowing the product to be dispensed and preventing the ambient air from coming into contact with the product. The invention also relates to a dispensing unit comprising such an applicator nozzle (2), a reservoir for the product (P), and system (M) capable of producing the ejection of the product (P) through the dispensing orifice (61) of the applicator nozzle (2).

9 Claims, 3 Drawing Sheets

DISPENSER FOR A PRODUCT WITH A LIQUID-TO-PASTY CONSISTENCY

The present invention relates to a nozzle for the application to a base of a product with a liquid-to-pasty consistency, as well as to a dispenser fitted with this applicator nozzle. This dispenser is intended, in particular, for the application of a cosmetic product to the skin or the mucous membranes, but it can also be used in other technical fields for dispensing a viscous product, for example, a glue. More particularly, the aim of the invention is the dispensing and application, to the lips, of a composition of rouge or salve with a creamy consistency, or of a skin treatment cream. The invention aims, in particular to preserve this composition under good conditions, without the risk of it deteriorating by contact with the ambient air.

Generally, such a dispenser comprises a reservoir for the product to be applied, and an element for the application of the said product. Thus from FR-A-2 588 733 an applicator is known for liquid products comprising a cylindrical reservoir which is separated by a partition into two compartments, namely a front compartment and a rear compartment. The first or front compartment, contains the liquid product and a piston. The rear compartment comprises means for driving the piston for provoking ejection of the product. This applicator comprises, moreover, a dispensing orifice which terminates in a hollow applicator brush.

When the user wishes to apply a cosmetic composition, for example a lipstick composition with a creamy consistency to the lips, this type of applicator with a brush does not permit a precise make-up of the lips, because of the flexibility of the bristles of the brush. The result is a feeling of discomfort as far as the user is concerned. Furthermore, with a brush-shaped applicator, it is not possible to apply compositions having a high viscosity. Moreover, when a coloured make-up cream is applied to the lips by means of the brush, the intensity of the pigments contained in the composition is softened and one thus obtains a matt make-up with a low covering capacity. U.S. Pat. No. 2,442,503 discloses a liquid lip rouge applicator which is provided with a flexible nozzle. This applicator has the following drawbacks. On the one hand when the product to be applied is very fluid there is the risk that it will flow out and thus foul the environment, in particular when the applicator is placed in a horizontal or downward directed position, for example during transport or storage. On the other hand when the product is susceptible to oxidation or to microbial contamination there is the risk that the ambient air coming into contact with the product will cause it to deteriorate.

The inventor has sought to avoid the drawbacks of the earlier dispensers and to ensure in particular a dispensing, in a metered mode, of a product of a creamy consistency, in particular of a product for the lips. The inventor has sought, in particular, to create an applicator providing great comfort in application, having good properties for the spreading of the product, and permitting a precise make-up of the lips.

These objectives are attained by choosing an applicator nozzle of a given shape, made of a flexible elastomeric material. The inventor has found that by choosing such a nozzle, it was possible to obtain a deep and glossy make-up of the lips. Moreover, by providing the application surface of this nozzle with cavities or grooves for the spreading, it was possible to obtain a faster and more homogeneous make-up than with an applicator brush. Furthermore, these grooves or cavities cut into the application surface of the nozzle allow the applicator to absorb any possible excess deposited on the lips.

Moreover, by providing this nozzle with a closing system which opens under the thrust of the product during the dispensing, the inventor has found that this product could be stored under good conditions, without risk of leaking, protected from the ambient air without the risk of contamination or degradation of the product, in particular in the case of a product that is susceptible to oxidation or to microbial contamination.

Thus the invention relates to an applicator nozzle for the dispensing and the application of a product with a liquid-to-pasty consistency, comprising an application surface provided with at least one dispensing orifice, characterized in that it comprises a one-way closing system allowing the product to be dispensed and preventing the ambient air from coming into contact with the product.

The expression "product with a liquid-to-pasty consistency" is understood to mean any composition capable of flow under the action of a dispensing means exerting on this product a thrust capable of producing the ejection of the product through the dispensing orifice. In practice, the viscosity of this product varies between 0.6 and 17 Pa-s.

In accordance with the invention, the dispensing orifice communicates with a duct for the delivery of the product passing through the nozzle, and with a reservoir forming part of a dispenser containing the product to be dispensed.

Advantageously, this one-way closing system is constituted by a valve intended to close the duct, and to open it under the thrust of the product during the dispensing of the latter and preventing the ambient air from entering into the reservoir when the dispensing ceases, stopping the outflow of the product instantaneously after the dispensing. Preferably, this valve is situated in the vicinity of the orifice, and more particularly at the end of the duct. Preferably the valve forms part of the nozzle, the nozzle and the valve thus being made in one piece. This valve may be in a resilient bearing contact against a seat formed by a rigid part, for example an attached part, that is provided with a duct for the delivery of the product.

Advantageously, the application surface of the nozzle has at least one cavity, or at least one groove, the orifices being situated in this cavity or in this groove.

Preferably, the cavity or the groove into which the orifice opens out is extended parallel to the application surface in passages so as to create channels for spreading the product when it is being applied to the base. This surface may be planar, concave or convex. In the case where these passages are cut into a concave or convex surface, the term "parallel" is understood to mean passages that are hollowed out in the application surface to a depth that is substantially constant.

According to a variant of the embodiment, the application surface may be constituted by a grille. This application surface may advantageously comprise two series of woven wires, the wires of one series being crossed with those of another series, in particular along two orthogonal directions. The application surface thus comprises a multitude of dispensing orifices. When a multitude of such orifices is made, their cross-section may be variable and have various shapes.

According to another variant of the embodiment, the application surface may have a multitude of pins separated by a multitude of cavities communicating with one another, at least one portion of the cavities being provided at their bottom with at least one dispensing orifice intended to communicate with a reservoir containing the product to be dispensed.

According to another variant of the embodiment, the applicator nozzle may be provided with an application surface having rugosities that are regularly interspaced over the whole or a part of that application surface.

The channels disposed in the application surface may be rectilinear or curvilinear and may, in particular, form closed curves.

So as to confer a softness of application and flexibility, the nozzle may advantageously be made of a flexible material, for example, of an elastomeric material chosen from the group comprising the elastomers of polyethylene, of polyurethane, or of polyester; polyether block amides; polyvinyls; terpolymers of ethylene, of propylene and of a diene (EPDM); sequenced polymers of styrene-butadiene (SEBS-SIS), silicones, nitrile rubbers, latex etc. These materials have the advantage of properly spreading and smoothing the product during its application to a base. Advantageously, the elastomeric material has a hardness comprised in the range of 40 to 70 Shore A.

The applicator nozzle described above is intended more particularly for the application of a product for the lips. Thus, according to a particularly worthwhile mode of embodiment of the invention, the applicator nozzle is shaped substantially in the form of an ogive provided with a planar or slightly convex application surface situated askew on the side of the ogive, and fitted with at least one dispensing orifice so as to imitate the shape of conventional solid stick lipsticks before any application. The advantage of a nondeformable semi-rigid nozzle as compared with a deformable stick is that it retains its shape until the tube of lipstick or lip salve has been used up and thus ensures a precise and homogeneous make-up right to the end of the stick.

The invention also relates to a dispenser for the dispensing and the application of a product with a liquid-to-pasty consistency, comprising a reservoir for the product to be dispensed, an applicator nozzle according to those described above mounted on the reservoir and comprising an application surface provided with at least one dispensing orifice, and means capable of producing the ejection of the product through the dispensing orifice, it being possible for the application surface of the nozzle to comprise at least one cavity or at least one groove, the orifice being situated at the bottom of this cavity or of this groove.

If required, this dispenser may comprise a detachable protective cap. In this case, the applicator nozzle advantageously includes an annular sealing bead whereon the protective cap is positioned with a friction fit.

Advantageously, this dispenser comprises a reservoir of a generally cylindrical shape, fitted with means capable of producing the ejection of the product, for example with a piston slidably mounted in this reservoir and driven in translation by a suitable mechanism. If required, the product may be kept in a conventional tube whose dispensing orifice is surmounted by an applicator nozzle in accordance with the invention, the dispensing of the product being effected by simple pressure on the tube.

A dispenser fitted with the applicator nozzle of the invention is more particularly suitable for the dispensing of a cosmetic composition, in particular of a composition for the lips with a liquid-to-pasty consistency, for example a lip rouge or lip salve product, conferring to the application a great feeling of comfort, and having good properties for spreading and smoothing the product on the lips whilst being capable of absorbing any possible excess of the product. The make-up obtained is precise and glossy.

Apart from the features set out above, the invention consists of a certain number of other features which will be discussed in greater detail below with regard to some examples of the embodiment described with reference to the attached drawings, which are in no way restrictive.

Figure 1:
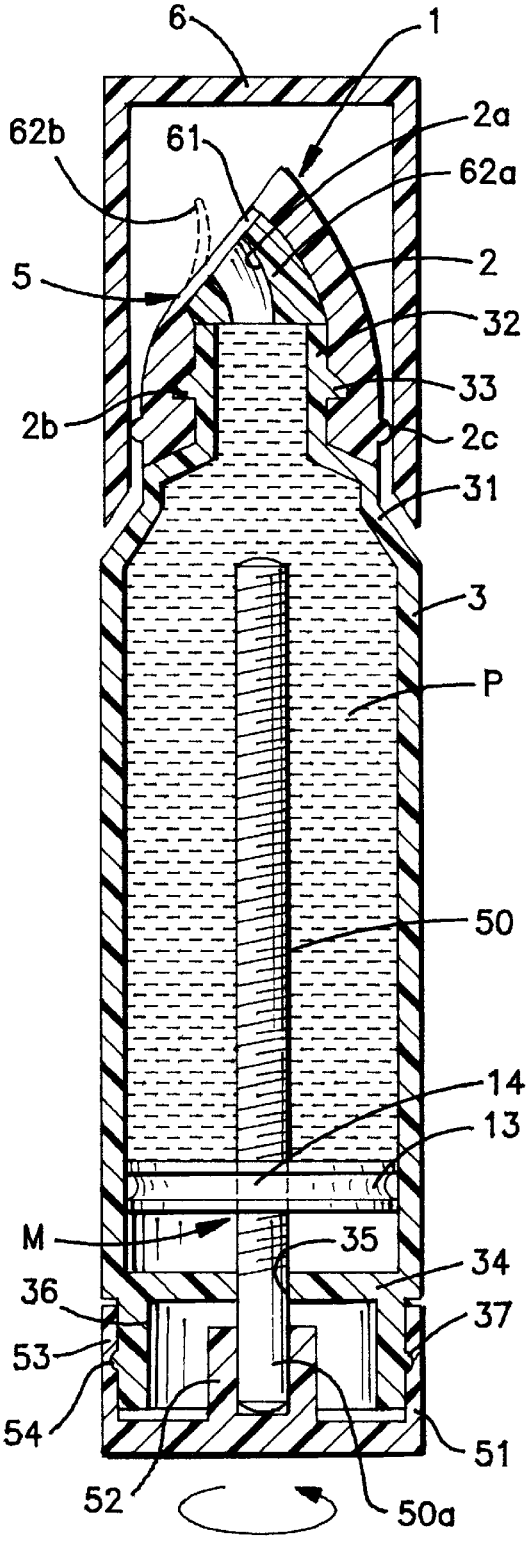
FIG. 1 is a longitudinal sectional view of a dispenser provided with an applicator nozzle in accordance with the invention.

Referring to FIG. 1 of the drawings, there may be seen a dispenser for the dispensing of a product P with a liquid-to-pasty consistency such as a lipstick composition, designated by the reference numeral 1 as a whole. This dispenser comprises a reservoir 3 of a generally cylindrical shape containing the product P. The reservoir 3 has in its upper portion a shoulder 31 surmounted by a cylindrical neck 32. An applicator nozzle 2, advantageously made of one of the flexible elastomeric materials mentioned above, is fitted on this neck 32.

This nozzle 2 is shaped substantially as an ogive having a planar application surface 5, situated askew on the side of the ogive. This surface 5 has a dispensing orifice 61. The nozzle 2 has a feeder duct 2*a* for causing the orifice 61 to communicate with the reservoir 3. The nozzle 2 has an internal annular groove 2*b* cooperating with an annular fixing bead 33 on the neck 32.

The reservoir 3 has a circular bottom 34 provided with a central hole 35 traversed by a threaded actuating stem 50. This stem 50 forms part of the means M capable of provoking ejection of the product P. These means M comprise, moreover, a piston 13 having an internally threaded duct 14 traversed by the threaded stem 50, this piston being capable of sliding in translation inside the reservoir 3 under the action of the actuating stem 50. These means comprise, moreover, an actuating ring 51 mounted for free rotation on a cylindrical skirt carried by the bottom 34.

The ring 51 has a cylindrically shaped central duct 52 in which there is fixed a free end 50*a* of the stem 50. The ring 51 has, moreover, a cylindrical skirt 53 surrounding the skirt 36 carried by the bottom 34. The skirts 36, 53 are provided with a catch engagement system constituted by a pair of an annular rib 54/annular bead 37 that cooperate with each other so that the ring 51 remains free for rotation.

The nozzle 2 comprises, moreover, an annular fastening bead 2*c*, capable of retaining a protective cap 6 by friction. Thus the cap 6 is mounted in a leakproof manner on the nozzle 2, which is useful, especially, for preventing the evaporation of any volatile constituents contained, if applicable, in the product P. The nozzle 2 has an application surface 5 comprising a cutout so as to form a one-way valve 62*b* bearing, in the rest position of the dispensing unit, against a rigid insert 62*a* and moving away under the thrust of the product during the dispensing (position 62*b*).

More particularly, this valve is an elastic sealing lip, coming back to the original position when the dispensing ceases. By action of the sealing lip, the product is pre-served in this dispenser during a prolonged period without deterioration. Because of this, it is not necessary to provide a protective cap for the dispenser.

By way of a variant, not shown, the means capable of producing the ejection of the product may be constituted by a ratchet mechanism such as described, for example in FR-A 2 588 733, in which a push button situated at the bottom of the applicator produces the advance of the piston towards the dispensing opening, and thus the dispensing of a dose of the product. It is also possible to make the means, which are capable of producing the ejection of the product, in the form of a cartridge (not shown) which is possibly interchangeable, containing the product to be dispensed, this cartridge being provided with a dispensing pump whose outlet stem is connected to an applicator nozzle in accordance with the invention. In this case, the user presses on the bottom of the cartridge at its end on the opposite side to the valve to dispense a dose of the product.

This dispenser functions as follows. By rotating the ring 51, the user causes the piston 13 to advance. A suitable quantity of the product P, for example, a lipstick composition, is then ejected through the orifice 61. By applying to the lips the application surface thus precharged with the product, the user proceeds with the making up of the lips. During this application, the product is diffused across the application surface 5.

The user experiences a feeling of great comfort and a great softness of application, and obtains, in a very precise way, a perfectly spread layer of the product.

Figure 2:
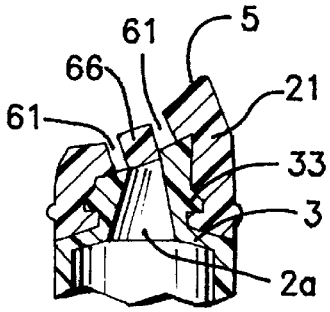
FIG. 2 is an axial section of another variant of the applicator nozzle with a valve capable of equipping the dispensing unit of FIG. 1.

FIG. 2 shows a longitudinal section of a flexible applicator nozzle 21 whose application surface 5 is convex and has a plurality of orifices 61. The application surface 5 has, moreover, an obturating pin 66 which obturates the neck 3 of the reservoir in the rest position, rising under the thrust of the product P and instantaneously stopping the dispensing when the dispensing is stopped.

Figure 3:
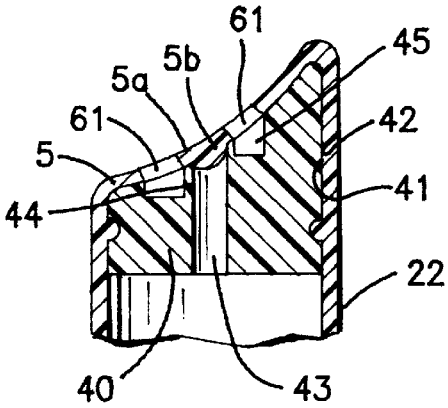
FIG. 3 is a longitudinal sectional view of a variant of the embodiment of the nozzle of FIG. 2, comprising a one-way dispensing valve.

As may be seen in FIG. 3, a nozzle 22 comprises a concave application surface 5 provided with a rigid or semi-rigid insert 40 provided with a duct 43 for the product, this insert being in intimate contact with the inner wall of the application surface 5. This insert 40 comprises an annular groove 45 connecting the dispensing orifices 61. A small tube 44 separates the annular groove 45 from the duct 43. The insert 40 has, moreover, a peripheral cutout 42 cooperating with an internal bead 41 of the applicator nozzle 23. In the rest position, the duct 43 is obturated by a central pin 5*b* joined to a portion 5*a* of the application surface. Thanks to the resilience of the material of which the nozzle 22 is made, this portion 5*a* is capable of rising under the thrust of the product, and of instantaneously closing the duct 43 in a leakproof manner when the dispensing stops, to prevent the ambient air from coming into contact with the product. Thus the product P is protected against fouling and oxidation. In this case, the nozzle 22 also serves as a protective cap.

Figure 4:
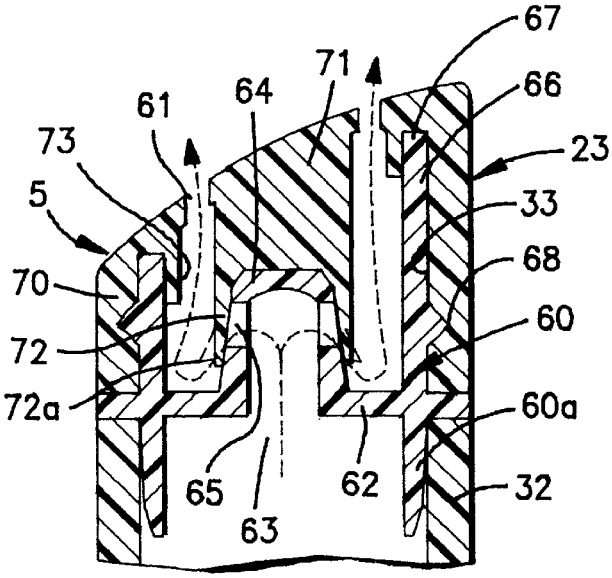
FIG. 4 is a longitudinal sectional view of another variant of the embodiment of FIG. 2, comprising a one-way dispensing valve.
Figure 11:
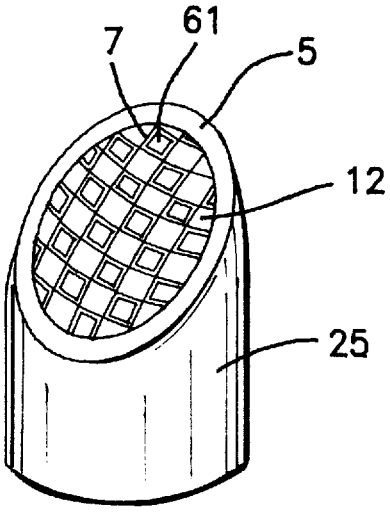

FIG. 4 shows an applicator nozzle 23 made of a polyethylene elastomer and having a variant of the dispensing valve. FIG. 11 shows that there is mounted on the neck 32 of the reservoir an outlet tube 60 of a generally cylindrical shape comprising a circular disk 62 that is provided with a central duct 63. On the side turned towards the neck, this disk 62 has a cylindrical sealing skirt 61*a* which is introduced with a force fit into the neck 32. On the opposite side to the neck 32, the disk 62 has a central dome 64 situated in the extension of the duct 63 and forming a blind hole. The dome 64 comprises one or several radial orifices 65. The disk 62 is moreover, provided with a cylindrical skirt 66 whose free end is cut at an angle. This skirt 66 has an annular bead 33 capable of cooperating with a complementary annular groove 68 of the internal cylindrical wall 70 of the applicator nozzle 23. This nozzle 23 has a slightly convex application surface 5 on which dispensing orifices 61 are arranged in a circle. On the side turned towards the disk 62, the application surface 5 has a sealing skirt 73 bearing in a leakproof manner on the skirt 66 carried by the disk 62. The application surface 5 is slightly convex.

On the same side, a central member 71, shaped as a glove finger joined to the application surface 5, extends in the direction towards the disk 62, so as to completely surround the dome 64. This glove finger 71 has an elastic cylindrical skirt 72 which covers the openings 65 and is capable of moving away from these openings under the thrust of the product and of returning immediately into the closed position when the dispensing stops. The skirt 72 constitutes the one-way dispensing valve according to the invention.

FIGS. 5 to 12 show several modes of embodiment of the applicator nozzle in accordance with the invention wherein the same constituent elements, or the elements performing a similar function, bear the reference numerals of FIG. 1. In order to simplify these figures, the one-way dispensing valve has not been represented. In the case of a nozzle bearing a multitude of dispensing orifices, one common valve may been realized, according to FIGS. 3 and 4. However it is possible to realize a multitude of individual valves, one valve for each orifice.

Figure 5:
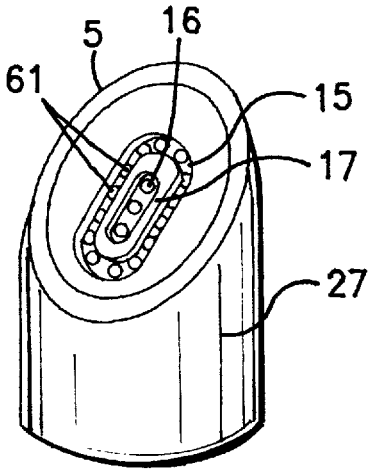
FIGS. 5 to 12 show, in perspective, diverse variants of the embodiment of the applicator nozzle capable of equipping the dispenser of FIG. 1.

FIG. 5 shows an applicator nozzle 27 comprising an application surface provided with a groove 15 of an oval shape and with an elongate cavity 16 disposed along the major axis of the oval groove defining an oval cross-section 17. At the bottom of the groove 15 and of the cavity 16, there are found the regularly interspaced dispensing orifices 61.

Figure 6:
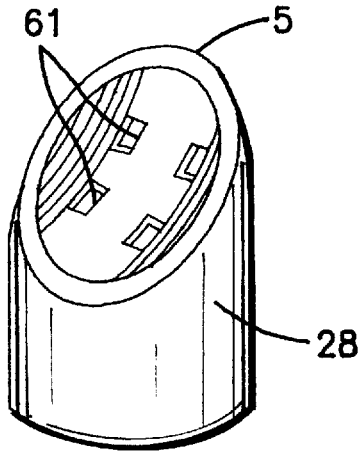

FIG. 6 shows an applicator nozzle 28, similar to that of FIG. 3, provided with a one-way dispensing valve such as shown in FIG. 3 and having a concave application surface 5 provided with four dispensing orifices 61.

Figure 7:
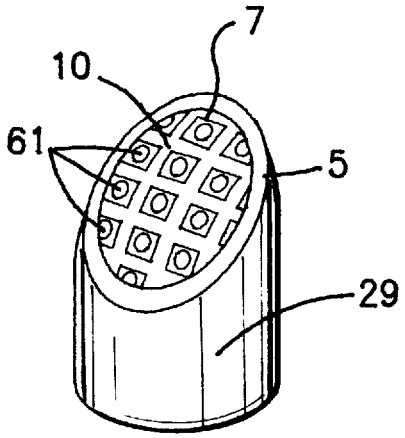

FIG. 7 shows in perspective an applicator nozzle 29 whose application surface 5 has a grille 10 whose square-shaped interstices form cavities 7, having at the bottom the dispensing orifices 61 which deliver the product P.

Figure 8:
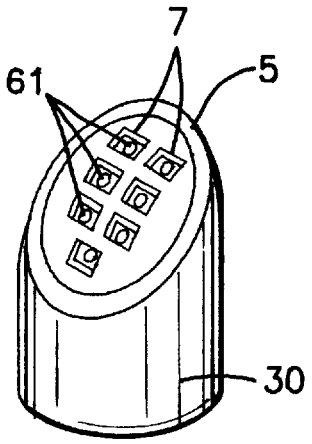

FIG. 8 shows a variant 30 of the nozzle of FIG. 7, wherein each of the cavities 7 are of the same kind as those of the nozzle 21 of FIG. 2, but arranged in a different way.

Figure 9:
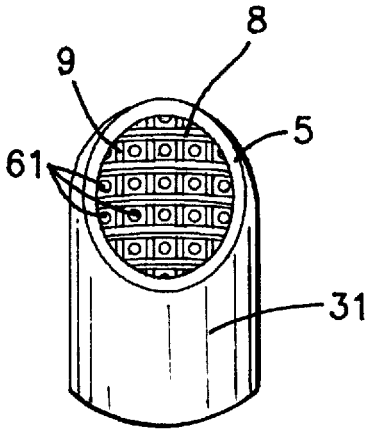

FIG. 9 shows a nozzle 31 whose application surface 5 has two series of small parallel bars, with the bars 8 of a first series substantially forming a right angle with those 9 of a second series situated at a different level. These small bars thus define an applicator grille. These bars may be optionally arranged in the manner of a woven material (an alternation of the overlapping of the two series of bars 8, 9).

Figure 10:
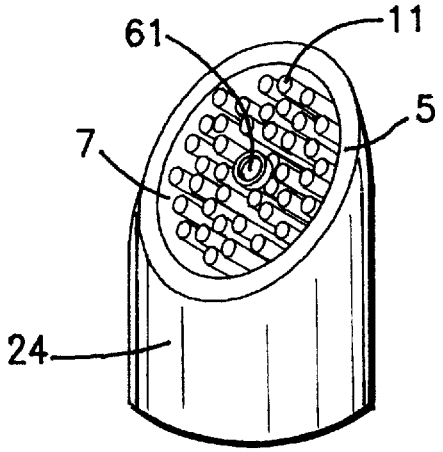

FIG. 10 shows a nozzle 24 having an application surface 5 provided with a central dispensing orifice 61 surrounded by a multitude of pins 11. Thus cavities 7 communicate with one another and are formed between the pins 11 of a cylindrical shape. The spaces between the pins define the cavities 7.

FIG. 11 shows an applicator nozzle 25 whose application surface 5 has pins 12 of a square cross-section disposed in alternation with cavities 7 of a square cross-section, at the bottom of which are dispensing orifices 4. A passage exists between a cavity and the adjacent cavities along the diagonal of the cross-sections of the cavities 7, defining channels for the product.

Figure 12:
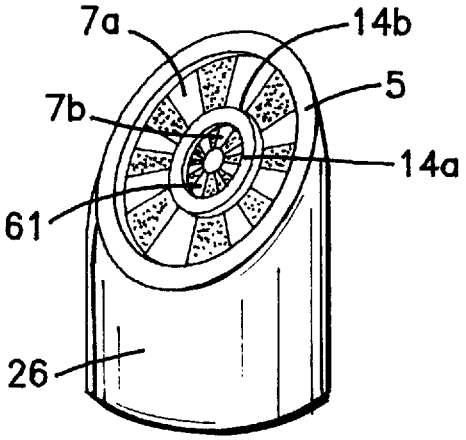

The applicator nozzle 26 of FIG. 12 has an application surface 5 formed by two concentric rings 14*a*, 14*b*, at the bottom of which are small radial bars 7*a*, 7*b*, the interstices between these small bars constituting dispensing orifices 4 for the product.

According to an embodiment, not shown, the surface 5 may have at least one zone provided with rugosities so as to obtain a granulated surface which facilitates the spreading of the product. The zone provided with rugosities may, for example, have the oval cross-section 17 of FIG. 5.

I claim:

1. An applicator tip for dispensing a product with a liquid-to-pasty consistency from a container, the tip comprising:

an oblique applicator surface of a resilient elastomeric material and with a continuous peripheral spreading board for application of the product to a person's lips;

plural one-way closures, each comprising a resilient closure means for flexibly closing a rigid opening which provides a passageway for the product from the container to said applicator surface, each said closure means flexing under pressure of the product being expelled through the associated said opening to dispense the product; and plural grooves in said applicator surface, each of said grooves in communication with at least one of said one-way closures for spreading the dispensed product across said applicator surface.

2. The applicator tip of claim 1, wherein each of said grooves communicates with a different one of said one-way closures.

3. The applicator tip of claim 1, wherein each of said plural grooves communicates with at least another one of said grooves to spread the dispensed product.

4. The applicator tip of claim 1, wherein a surface of each said closure means is substantially flush with said applicator surface.

5. The applicator tip of claim 1, wherein each said closure means is in one of said grooves and entirely recessed beneath said applicator surface.

6. The applicator tip of claim 1, wherein said grooves define a grid of generally linear and parallel column ridges and generally linear and parallel row ridges which intersect to define a plurality of generally square interstices, each of said interstices being a depressed surface between adjacents ones of said column and row ridges into which a respective one of said one-way closures opens.

7. The applicator tip of claim 1, wherein said grooves define a grid of generally annular ridges and generally radial rises which intersect to define a plurality of interstices, each of said interstices being a depressed surface between adjacents ones of said ridges and rises into which a respective one of said one-way closures opens.

8. An applicator nozzle for dispensing a product with a liquid-to-pasty consistency from a container, the nozzle having an oblique applicator surface for application of the product, the nozzle comprising:

a grid of generally linear and parallel column ridges and generally linear and parallel row ridges which intersect to define a plurality of generally square interstices, wherein tops of said row ridges define said applicator surface, tops of said column ridges not extending to said applicator surface, and each of said interstices being a depressed surface between adjacents ones of said column and row ridges;

a one-way orifice opening to said depressed surface within each of said interstices for dispensing the product to said applicator surface, each said orifice having a flexible closure for opening in response to pressure of the product being ejected from the container to permit the product to be dispensed onto said depressed surface and for closing in the absence of pressure of the product to prevent ambient air from entering the container when the product is not being dispensed; and a duct for providing the product from the container to each said orifice.

9. An applicator nozzle for dispensing a product with a liquid-to-pasty consistency from a container, the nozzle having an oblique applicator surface for application of the product, the nozzle comprising:

a grid of generally annular ridges and generally radial rises which intersect to define a plurality of interstices, wherein tops of said ridges define said applicator surface, tops of said radial rises not extending to said applicator surface, and each of said interstices being a depressed surface between adjacents ones of said ridges and rises;

a one-way orifice opening to said depressed surface within each of said interstices for dispensing the product to said applicator surface, each said orifice having a flexible closure for opening in response to pressure of the product being ejected from the container to permit the product to be dispensed onto said depressed surface and for closing in the absence of pressure of the product to prevent ambient air from entering the container when the product is not being dispensed; and a duct for providing the product from the container to each said orifice.

* * * * *

UNITED STATES PATENT AND TRADEMARK OFFICE

CERTIFICATE OF CORRECTION

PATENT NO. : 5,772,347

DATED : June 30, 1998

INVENTOR(S) : Jean-Louis Gueret

It is certified that error appears in the above-identified patent and that said Letters Patent is hereby corrected as shown below:

Column 5, line 53, change "61a" to --60a--.

Signed and Sealed this

Ninth Day of March, 1999

*Attest:*

*Attesting Officer*

Q. TODD DICKINSON

*Acting Commissioner of Patents and Trademarks*